US007950096B2

(12) United States Patent
Williamson

(10) Patent No.: US 7,950,096 B2
(45) Date of Patent: May 31, 2011

(54) FLUID FLOW SYSTEM BRIDGE WITH WALKWAY

(75) Inventor: John Williamson, Morgan City, LA (US)

(73) Assignee: Petroleum Specialty Rental, LLC, Morgan City, LA (US)

( * ) Notice: Subject to any disclaimer, the term of this patent is extended or adjusted under 35 U.S.C. 154(b) by 24 days.

(21) Appl. No.: 12/565,491

(22) Filed: Sep. 23, 2009

(65) Prior Publication Data

US 2010/0071140 A1 Mar. 25, 2010

Related U.S. Application Data

(60) Provisional application No. 61/099,314, filed on Sep. 23, 2008.

(51) Int. Cl.
*B63B 27/30* (2006.01)

(52) U.S. Cl. ..... 14/69.5; 14/27; 114/362; 414/137.2

(58) Field of Classification Search ..... 14/69.5, 14/27; 114/362; 414/137.2
See application file for complete search history.

(56) References Cited

U.S. PATENT DOCUMENTS

| | | | | |
|---|---|---|---|---|
| 3,521,316 | A * | 7/1970 | Adams et al. | 14/71.5 |
| 4,391,297 | A * | 7/1983 | Knight | 137/615 |
| 4,543,677 | A * | 10/1985 | Haglund et al. | 14/71.5 |
| 4,572,550 | A * | 2/1986 | Harder | 285/47 |
| 4,715,077 | A * | 12/1987 | Shepheard | 14/71.5 |
| RE32,687 | E * | 6/1988 | Shepheard | 14/71.5 |
| 6,347,424 | B1 * | 2/2002 | Vatne | 14/69.5 |
| 6,609,544 | B1 | 8/2003 | Williamson | |
| 7,017,741 | B1 | 3/2006 | Williamson | |
| 7,669,271 | B2 * | 3/2010 | Gonzalez Alemany et al. | 14/71.5 |
| 2008/0185064 | A1 * | 8/2008 | Kolzumi et al. | 138/126 |

* cited by examiner

*Primary Examiner* — Raymond W Addie
(74) *Attorney, Agent, or Firm* — Garvey, Smith, Nehrbass & North, L.L.C.; Charles C. Garvey, Jr.; Vanessa M. D'Souza

(57) ABSTRACT

A method for transferring fluids and personnel between a work vessel and an offshore marine platform includes the placement of an elongated self-supporting frame between the work vessel and the marine platform. A walkway is provided on the frame. Pipe racks are provided on the frame, one pipe rack on each side of the frame so that a pair of pipe racks are on opposing sides of the frame. Hand rails are mounted in between the walkway and each pipe rack. A fluid holding pan extends under the walkway and the flowlines. In this fashion, fluid that falls from either a pipe rack or a walkway to the pan can travel through a common drain or collection area.

22 Claims, 5 Drawing Sheets

FLUID FLOW SYSTEM BRIDGE WITH WALKWAY

CROSS-REFERENCE TO RELATED APPLICATIONS

Priority of my U.S. Provisional Patent Application Ser. No. 61/099,314, filed 23 Sep. 2008, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a transfer of fluids and personnel between an offshore marine platform and an attending work vessel. More particularly, the present invention relates to a transfer of fluids and personnel between an offshore marine platform and an attending work vessel wherein an improved bridge apparatus provides a centralized walkway with a pair of pipe racks placed on opposing sides of the walkway, and wherein an underlying pan extends from one side of the bridge to the other, and wherein any fluid that falls to the pan is able to travel from a position under either a pipe rack or a walkway to a drain or point of collection.

2. General Background of the Invention

In the offshore marine industry, offshore marine platforms are employed in the drilling and production of oil and gas. These offshore marine platforms frequently require the assistance of a work vessel. The work vessel can for example be a self-elevating multi-leg platform or hull such as a jack-up rig or lift boat. Other examples of suitable support vessels or boats that could employ the method and apparatus of the present invention are remedial/workover work type barges or vessels.

Patents have issued for bridges that extend between an offshore oil and gas well drilling or production platform and a lift boat or like attending vessel. Examples can be seen in the Williamson U.S. Pat. Nos. 6,609,544 and 7,017,741.

In some situations, it is important to provide a walkway that is unencumbered and an accommodation for flow lines as part of a bridge arrangement.

BRIEF SUMMARY OF THE INVENTION

The present invention provides an improved method and apparatus for transferring fluids and personnel between a work vessel and a marine platform. For example, the present invention could be used on small, single well platforms wherein working space is limited or cramped. The method includes the placing of an elongated self-supporting frame between the work vessel and the marine platform, the frame having first and second ends.

A walkway is provided that extends from one end to the other of the frame. Fluid flow transfer pipe racks are placed on opposing sides of the walkway, each pipe rack configured to hold a flow line or flowline or multiple flowlines.

Hand rails are placed in between the walkway and each flowline or flow line. The frame has a fluid holding pan that extends under the walkway and under the flowline.

Sockets are provided on the frame that enable the frame to be lifted with a forklift, the forklift tines engaging the sockets.

The fluid holding pan enables fluid flow between an area under a pipe rack to an area under the walkway.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
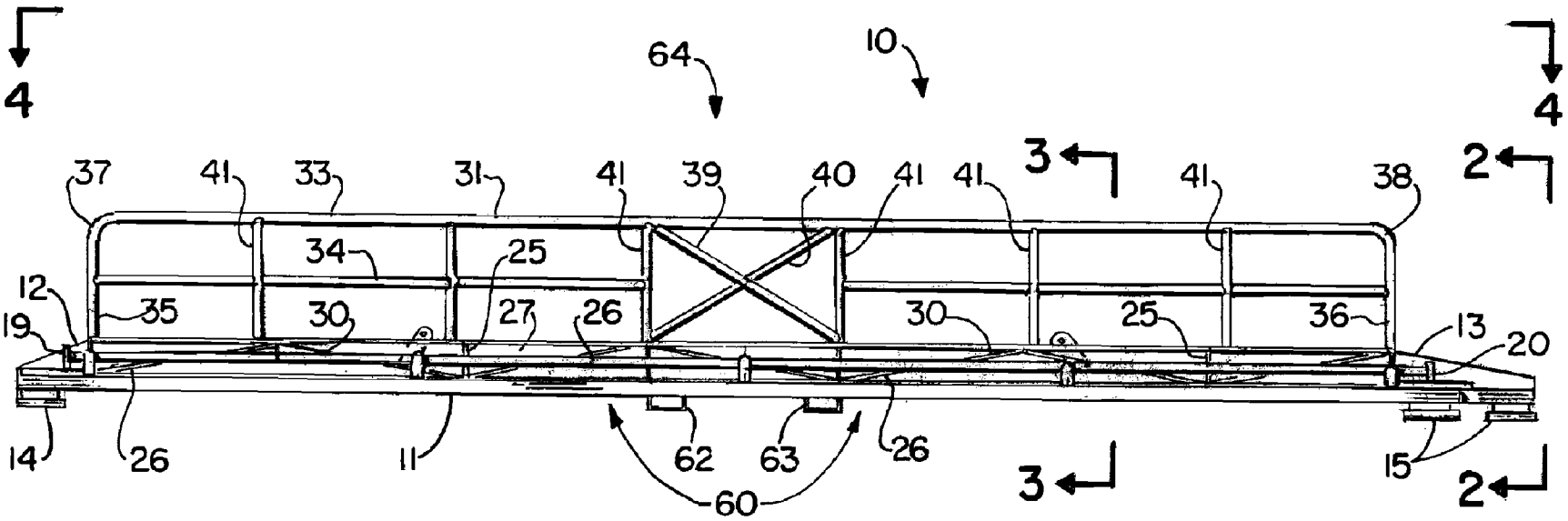
FIG. 1 is an elevation view of the preferred embodiment of the apparatus of the present invention.
Figure 2:
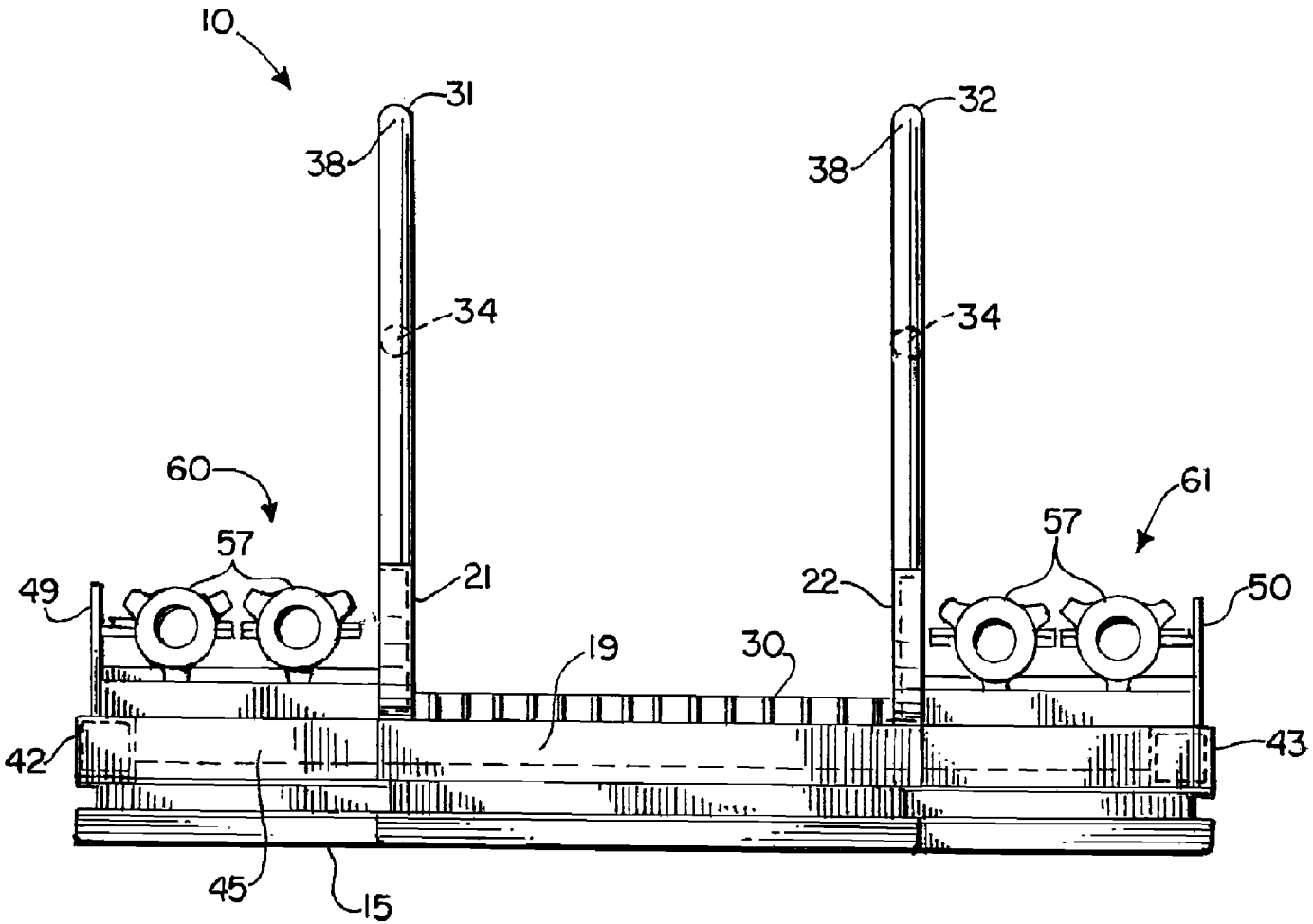
FIG. 2 is an end view of the preferred embodiment of the apparatus of the present invention, taken along lines 2-2 of FIG. 1.

FIGS. 1-5 show generally the preferred embodiment of the apparatus of the present invention, designated generally by the numeral 10. Fluids flow bridge and walkway 10 provides a frame 11 having end portions 12, 13. Each end portion 12, 13 can be fitted with one or more feet or pads 14, 15. The foot or pad 14, 15 can be in each case a thick, rectangular foot or pad of ultra high molecular weight polyethylene, composite, or other polymeric material. Preferably such material for foot/pad 14, 15 would not cause damage with a metal surface upon which it rests, such as the deck of an oil platform or the deck of a support vessel, lift boat, etc. An enlarged pan 16 extends from foot/pad 14 to the other foot/pad 15. Pan 16 has side walls 17, 18 and end walls 19, 20. The side walls 17, 18 and end walls 19, 20 together form a peripheral barrier that retains any fluid on pan 16 that might fall from walkway 30 or from either pipe rack 60, 61. Walkway 30 can be of grating 28 having a serrated or like upper surface 29. Longitudinally extending beams 21, 22 extend from end wall 19 to end wall 20. The beam 21 can provide upper 23 and lower 24 flanges. Each beam 21, 22 can provide a plurality of spaced apart vertical stiffeners 25 and diagonally extending stiffeners 26. The stiffeners 25, 26 can be attached to flanges 23, 24 and web 27 of each longitudinal beam 21, 22. Hand rails 31, 32 extend upwardly from upper flange 23 of each longitudinal beam 21, 22.

Each of the hand rails 31, 32 can be comprised of an upper rail section 33 and a lower rail section 34. The hand rails 31, 32 further include end posts 35, 36. Each end post 35, 36 can join to an upper rail section 33 at a bend 37, 38 as shown in FIG. 1.

Each hand rail 31, 32 can further be braced at its center part with diagonal braces 39, 40 as shown in FIG. 1. The combination of diagonal braces 39, 40 and adjacent intermediate posts 41 create a strong center part for each hand rail 31, 32 just above fork lift tine sockets 62, 63. During lifting, a fork lift inserts its tines into sockets 62, 63 and can lift and transport the bridge 10. This creates a great deal of stress at the center 64 part of bridge 10, thus reinforced with cross braces or diagonal braces 39, 40 as shown.

Peripheral beams 42, 43, transverse beams 44 and the end walls 19, 20 define a structural frame that interconnects with the longitudinal beams 21, 22. Further, a hand rail 31 or 32 is mounted above a longitudinal beam 21, 22 and connected thereto with welding for example.

Figure 3:
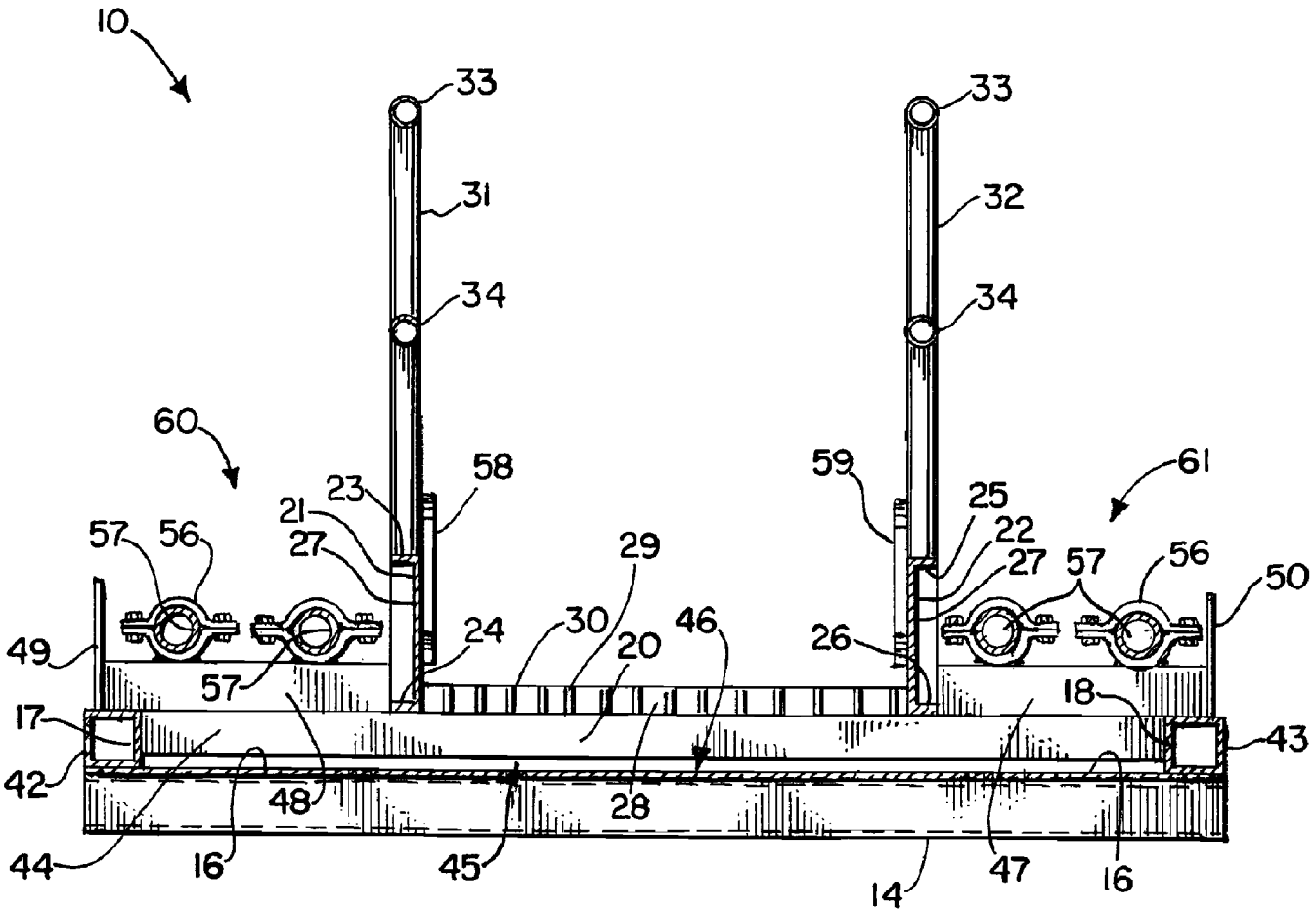
FIG. 3 is a sectional view of the preferred embodiment of the apparatus of the present invention, taken along lines 3-3 of FIG. 1.
Figure 4:
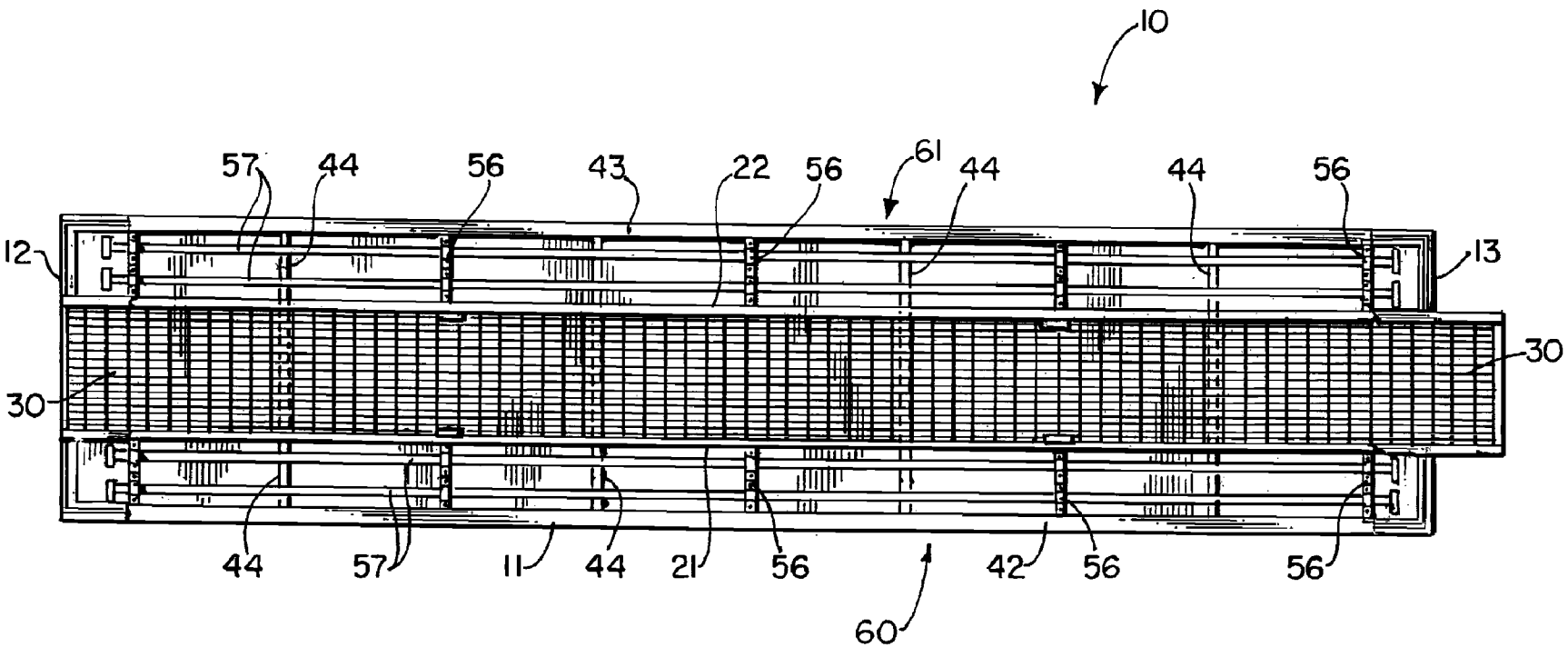
FIG. 4 is a top view of the preferred embodiment of the apparatus of the present invention, taken along lines 4-4 of FIG. 1.

A gap 45 is provided above surface 46 of pan 16 and under each of the transverse beams 44 as shown in FIG. 3. This gap 45 enables any fluid that falls from either pipe rack 60 or 61 or from walkway 30 to be restrained upon surface 46 within the confines of the side walls 17, 18 and end walls 19, 20 of bridge 10. Later, the bridge 10 can be tilted in order to pool any collected liquid in one corner of the pan 16 or in a low part of the pan 16 for retrieval using a portable pump or other drain. In the preferred embodiment, the overall dimensions of the drip pan 16 below the fluids flow bridge 10 with walkway 30 is 30 feet 10 inches (9.40 meters) in length and 62.75 inches (1.6 meters) in width. With those dimensions, it is foreseen that the pan 16 would have the capacity to hold a maximum of 392.16 gallons (8.71 barrels or 1484 liters) of fluid.

Pipe rack support beams 47, 48 extend upwardly from transverse beams 44 at intervals for supporting pipe clamps 56. The pipe clamps 56 are used to support elongated pipe sections 57.

Side wall extensions 49, 50 can be provided that extend upwardly from peripheral beams 42, 43 for protection of pipe clamps 56 and pipe sections 57.

Figure 5:
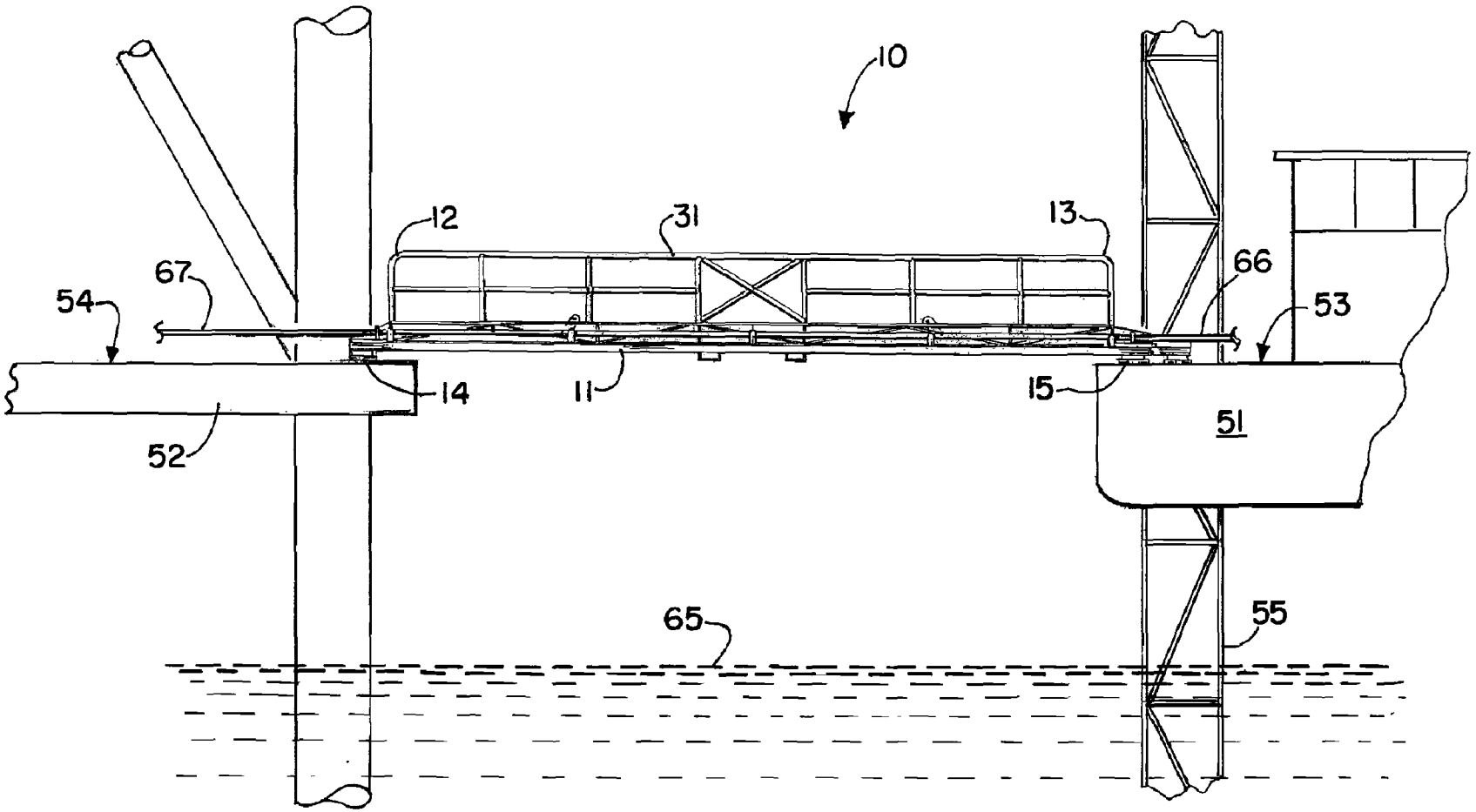
FIG. 5 is an elevation view of the preferred embodiment of the apparatus of the present invention.

In FIG. 5, an attending vessel 51 is shown placed next to a marine platform 52. The marine platform 52 can be an oil and gas well drilling platform or an oil and gas well production facility. The marine vessel 51 can be a lift boat, jack-up platform, or other suitable work vessel or attending vessel. A deck 53 is provided on attending vessel 51. A deck 54 is provided on platform 52. If the vessel 51 is a lift boat or jack-up rig, it typically provides multiple legs 55 as is known. These legs 55 enable a jacking mechanism to elevate the vessel 51 above a water surface 65 so that the deck 53 of vessel 51 and the deck 54 of platform 52 can be placed at about the same elevation. In this fashion, workers can cross bridge 10 using walkway 30. At the same time, fluids can be transferred between vessel 51 and platform 52 using pipe sections 57 and hoses 66, 67.

Bridge 10 can be provided with padeyes/lifting eyes 58, 59 which can be welded to longitudinal beams 21, 22 as shown in FIG. 3. The lifting eyes 58, 59 enable the bridge 10 to be lifted using a crane or other lifting device wherein rigging such as slings and or spreader bars are employed in between the lifting eyes 58, 59 and the lift line or hook of the crane. Additionally, padeyes can be provided on all four corners of frame 11. Such padeyes enable attachment of chains, hooks, cables to help stabilize the frame position, keeping the frame 11 from detaching during movement of the attending vessel such as with rough wave action.

The following is a list of parts and materials suitable for use in the present invention.

PARTS LIST

| Part Number | Description |
|---|---|
| 10 | fluids flow bridge and walkway |
| 11 | frame |
| 12 | end portion |
| 13 | end portion |
| 14 | foot/pad |
| 15 | foot/pad |
| 16 | pan |
| 17 | side wall |
| 18 | side wall |

-continued

| Part Number | Description |
|---|---|
| 19 | end wall |
| 20 | end wall |
| 21 | longitudinal beam |
| 22 | longitudinal beam |
| 23 | flanges |
| 24 | flanges |
| 25 | vertical stiffener |
| 26 | diagonal stiffener |
| 27 | web |
| 28 | grating |
| 29 | upper surface |
| 30 | walkway |
| 31 | hand rail |
| 32 | hand rail |
| 33 | upper rail section |
| 34 | lower rail section |
| 35 | end post |
| 36 | end post |
| 37 | bend |
| 38 | bend |
| 39 | diagonal brace |
| 40 | diagonal brace |
| 41 | intermediate post |
| 42 | peripheral beam |
| 43 | peripheral beam |
| 44 | transverse beam |
| 45 | gap |
| 46 | surface of pan |
| 47 | pipe rack support beam |
| 48 | pipe rack support beam |
| 49 | side wall extension |
| 50 | side wall extension |
| 51 | attending vessel |
| 52 | marine platform |
| 53 | vessel deck |
| 54 | platform deck |
| 55 | vessel leg |
| 56 | pipe clamp |
| 57 | pipe section |
| 58 | lifting eye |
| 59 | lifting eye |
| 60 | pipe rack |
| 61 | pipe rack |
| 62 | fork lift tine socket |
| 63 | fork lift tine socket |
| 64 | center portion |
| 65 | water surface |
| 66 | hose |
| 67 | hose |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method for transferring fluids and personnel between a work vessel and a marine platform comprising the steps of:

a) placing an elongated, self-supporting frame between the work vessel and the marine platform, the frame having first and second ends;

b) providing a walkway on the frame that extends from one end to the other end of the frame;

c) placing pipe racks on opposing sides of the walkway, each pipe rack configured to hold a flowline, at least one flow line being supported by a said rack;

d) placing handrails in between the walkway and each pipe rack;

e) the frame having a fluid holding pan that extends under the walkway and the pipe racks;

f) wherein the fluid holding pan enables flow of fluid that leaks from a pipe on a rack between an area under a pipe rack to an area under the walkway; and g) transferring fluid from one frame end to the other frame end via one or more flow lines that occupy a said pipe rack.

2. The method of claim 1 wherein the fluid holding pan enables fluid flow from an area under one pipe rack to an area under the other pipe rack.

3. The method of claim 1 wherein each hand rail is mounted upon a longitudinally extending centrally positioned beam, the walkway being positioned in between a pair of the centrally positioned beams.

4. The method of claim 3 further comprising a plurality of peripheral beams, two being peripheral end beams that are welded to the pair of longitudinally extending centrally positioned beams.

5. The method of claim 4 wherein there are lifting eyes attached to each of the centrally positioned beams.

6. The method of claim 3 wherein a pair of the peripheral beams define to left and right sides of the frame.

7. The method of claim 6 wherein there are four peripheral beams that include a pair of side peripheral beams and a pair of end peripheral beams.

8. The method of claim 5 wherein each lifting eye is a diagonally positioned member.

9. The method of claim 7 further comprising intermediate beams parallel to the end peripheral beams.

10. A method for transferring fluids and personnel between a work vessel and a marine platform comprising the steps of:

a) placing an elongated, self-supporting frame between the work vessel and the marine platform, the frame having first and second ends;

b) providing a walkway on the frame that extends from one end to the other end of the frame;

c) placing pipe racks on opposing sides of the walkway, each pipe rack supporting a flow line;

d) placing handrails in between the walkway and each flow line;

e) the frame supporting a fluid holding pan that is an uninterrupted surface that enables fluid falling from a pipe rack, flow line or walkway to flow uninterrupted over the surface; and f) sockets on the frame that enable the frame to be lifted with forklift tines that engage the sockets.

11. A bridge apparatus that enables transfer of fluids and personnel between a work vessel and a marine platform comprising:

a) an elongated, self-supporting frame sized to span between the work vessel and the marine platform, the frame having first and second ends;

b) a personnel walkway on the frame that extends from one end to the other end of the frame;

c) pipe racks that enable support of multiple fluid transfer flow lines on each opposing side of the walkway, each pipe rack configured to hold a flow line;

d) handrails in between the walkway and each flowline;

e) the frame having a fluid holding pan that extends under the walkway and the flow lines;

f) sockets on the frame that enable the frame to be lifted with forklift tines that engage the sockets; and g) wherein the fluid holding pan enables flow between an area under a pipe rack to an area under the walkway.

12. The bridge apparatus of claim 11 wherein the fluid holding pan enables fluid flow from an area under one pipe rack to an area under the other pipe rack.

13. The bridge apparatus of claim 11 wherein each hand rail is mounted upon a longitudinally extending centrally positioned beam, the walkway being positioned in between a pair of the centrally positioned beams.

14. The bridge apparatus of claim 13 further comprising a plurality of peripheral beams, two being peripheral end beams that are welded to the pair of longitudinally extending centrally positioned beams.

15. The bridge apparatus of claim 14 wherein there are lifting eyes attached to each of the centrally positioned beams.

16. The bridge apparatus of claim 13 wherein a pair of the peripheral beams define to left and right sides of the frame.

17. The bridge apparatus of claim 16 wherein there are four peripheral beams that include a pair of side peripheral beams and a pair of end peripheral beams.

18. The bridge apparatus of claim 15 wherein each lifting eye is a diagonally positioned member.

19. The bridge apparatus of claim 17 further comprising intermediate beams parallel to the end peripheral beams.

20. A bridge apparatus that enables transfer of fluids and personnel between a work vessel and a marine platform comprising:

a) an elongated, self-supporting frame between the work vessel and the marine platform, the frame having first and second ends;

b) a walkway on the frame that extends from one end to the other end of the frame;

c) pipe racks and a fluid transfer flow line on each opposing side of the walkway, each pipe rack configured to hold a flow line;

d) the frame including a pair of longitudinally extending beams positioned on opposing sides of the walkway, each beam supporting a handrail that extends along the beam and in between the walkway and a pipe rack; and e) the frame supporting a fluid holding pan that collects fluid falling from a pipe rack, pipe section or walkway.

21. The apparatus of claim 20 further comprising sockets on the frame that enable the frame to be lifted with forklift tines that engage the sockets.

22. A bridge apparatus that enables transfer of fluids and personnel between a work vessel and a marine platform comprising:

a) an elongated, self-supporting frame having first and second ends positioned between the work vessel and the marine platform;

b) a walkway on the frame that extends from the first end to the second end of the frame;

c) pipe racks on opposing sides of the walkway, each pipe rack supporting a flow line;

d) the frame further comprising a pair of longitudinally extending beams positioned on opposing sides of the walkway, each beam supporting a handrail that extends along the beam in between the walkway and a pipe rack; and e) a fluid holding pan extending substantially the length of and supported by the frame to collect fluid falling from the pipe rack, flow line, or walkway to prevent fluid discharge below the frame.

* * * * *